US008102201B2

(12) United States Patent
Marinca

(10) Patent No.: US 8,102,201 B2
(45) **Date of Patent: *Jan. 24, 2012**

(54) REFERENCE CIRCUIT AND METHOD FOR PROVIDING A REFERENCE

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 198 days.

This patent is subject to a terminal disclaimer.

(21) Appl. No.: 12/495,650

(22) Filed: Jun. 30, 2009

(65) Prior Publication Data

US 2010/0001711 A1 Jan. 7, 2010

Related U.S. Application Data

(63) Continuation-in-part of application No. 11/529,723, filed on Sep. 25, 2006, now Pat. No. 7,576,598.

(51) Int. Cl.
*G05F 3/08* (2006.01)

(52) U.S. Cl. ..... 327/539; 323/314

(58) Field of Classification Search ..... None
See application file for complete search history.

(56) References Cited

U.S. PATENT DOCUMENTS

| | | | | |
|---|---|---|---|---|
| 4,399,398 | A | | 8/1983 | Wittlinger |
| 4,475,103 | A | | 10/1984 | Brokaw et al. |
| 4,603,291 | A | | 7/1986 | Nelson |
| 4,714,872 | A | | 12/1987 | Traa |
| 4,800,339 | A | | 1/1989 | Tanimoto et al. |
| 4,808,908 | A | | 2/1989 | Lewis et al. |
| 4,939,442 | A | | 7/1990 | Carvajal et al. |
| 4,990,803 | A | * | 2/1991 | Gilbert ..... 327/351 |
| 5,053,640 | A | | 10/1991 | Yum |
| 5,119,015 | A | | 6/1992 | Watanabe |
| 5,229,711 | A | | 7/1993 | Inoue |
| 5,325,045 | A | | 6/1994 | Sundby |
| 5,352,973 | A | | 10/1994 | Audy |
| 5,371,032 | A | | 12/1994 | Nishihara |
| 5,424,628 | A | | 6/1995 | Nguyen |
| 5,479,092 | A | * | 12/1995 | Pigott et al. ..... 323/313 |
| 5,512,817 | A | | 4/1996 | Nagaraj |

(Continued)

FOREIGN PATENT DOCUMENTS

EP 0510530 10/1992

(Continued)

OTHER PUBLICATIONS

PCT/EP2008/058685 International Search Report and written opinion, Oct. 1, 2008.

(Continued)

*Primary Examiner* — Lincoln Donovan
*Assistant Examiner* — Terry L Englund
(74) *Attorney, Agent, or Firm* — Kenyon & Kenyon LLP

(57) ABSTRACT

A reference circuit configured to provide a reference value. The circuit includes a first circuit unit which is configured to provide a first electrical representation that varies linearly with temperature and has a crossover point where its polarity relative to zero changes from a negative value to a positive value. A second circuit unit is configured to provide a second electrical representation that varies linearly with temperature. The first and second circuit units are operable for facilitating combining the first and second electrical representations such that the combination has a value corresponding to the value of the second electrical representation at a reference temperature.

20 Claims, 8 Drawing Sheets

U.S. PATENT DOCUMENTS 5,563,504 A 10/1996 Gilbert et al.
5,646,518 A 7/1997 Lakshmikumar et al.
5,821,807 A 10/1998 Brooks
5,828,329 A 10/1998 Burns
5,933,045 A 8/1999 Audy et al.
5,952,873 A 9/1999 Rincon-Mora
5,977,813 A * 11/1999 Boerstler ..... 327/378
5,982,201 A 11/1999 Brokaw et al.
6,002,293 A 12/1999 Brokaw
6,075,354 A 6/2000 Smith et al.
6,157,245 A 12/2000 Rincon-Mora
6,218,822 B1 4/2001 MacQuigg
6,225,796 B1 5/2001 Nguyen
6,255,807 B1 7/2001 Doorenbos et al.
6,329,804 B1 12/2001 Mercer
6,329,868 B1 12/2001 Furman
6,356,161 B1 3/2002 Nolan et al.
6,362,612 B1 3/2002 Harris
6,373,330 B1 4/2002 Holloway
6,426,669 B1 7/2002 Friedman et al.
6,462,625 B2 10/2002 Kim
6,483,372 B1 11/2002 Bowers
6,489,787 B1 12/2002 McFadden
6,489,835 B1 12/2002 Yu et al.
6,501,256 B1 12/2002 Jaussi et al.
6,509,783 B2 * 1/2003 Chowdhury ..... 327/513
6,529,066 B1 3/2003 Guenot et al.
6,531,857 B2 3/2003 Ju
6,549,072 B1 4/2003 Vernon
6,590,372 B1 7/2003 Wiles, Jr.
6,614,209 B1 9/2003 Gregoire, Jr.
6,642,699 B1 11/2003 Gregoire, Jr.
6,661,713 B1 12/2003 Kuo
6,664,847 B1 12/2003 Ye
6,690,228 B1 2/2004 Chen et al.
6,791,307 B2 9/2004 Harrison
6,798,286 B2 9/2004 Dauphinee et al.
6,801,095 B2 10/2004 Renninger, II
6,828,847 B1 12/2004 Marinca
6,836,160 B2 12/2004 Li
6,853,238 B1 2/2005 Dempsey et al.
6,879,141 B1 * 4/2005 Ho ..... 323/315
6,885,178 B2 4/2005 Marinca
6,891,358 B2 5/2005 Marinca
6,894,544 B2 5/2005 Gubbins
6,919,753 B2 7/2005 Wang et al.
6,930,538 B2 8/2005 Chatal
6,958,643 B2 10/2005 Rosenthal
6,987,416 B2 1/2006 Ker et al.
6,992,533 B2 1/2006 Hollinger et al.
7,012,416 B2 3/2006 Marinca
7,057,444 B2 6/2006 Illegems
7,068,100 B2 6/2006 Dauphinee et al.
7,088,085 B2 8/2006 Marinca
7,091,761 B2 8/2006 Stark et al.
7,112,948 B2 9/2006 Daly et al.
7,170,336 B2 1/2007 Hsu
7,173,407 B2 2/2007 Marinca
7,193,454 B1 3/2007 Marinca
7,199,646 B1 4/2007 Zupcau et al.
7,211,993 B2 5/2007 Marinca
7,224,210 B2 5/2007 Garlapati et al.
7,236,047 B2 6/2007 Tachibana et al.
7,248,098 B1 7/2007 Teo
7,260,377 B2 8/2007 Burns et al.
7,301,321 B1 11/2007 Uang et al.
7,372,244 B2 5/2008 Marinca
7,411,380 B2 8/2008 Chang et al.
7,472,030 B2 12/2008 Scheuerlein
7,482,798 B2 1/2009 Han
7,543,253 B2 * 6/2009 Marinca et al. ..... 323/313
7,576,598 B2 * 8/2009 Marinca ..... 327/539
7,696,909 B2 * 4/2010 Oberhuber ..... 341/119
2003/0234638 A1 12/2003 Eshraghi et al.
2005/0073290 A1 4/2005 Marinca et al.
2005/0194957 A1 9/2005 Brokaw
2005/0237045 A1 10/2005 Lee et al.
2006/0017457 A1 1/2006 Pan et al.
2006/0038608 A1 2/2006 Ozawa
2007/0176591 A1 8/2007 Kimura
2008/0018319 A1 1/2008 Chang et al.
2008/0074172 A1 3/2008 Marinca
2008/0224759 A1 9/2008 Marinca
2008/0265860 A1 10/2008 Dempsey et al.

FOREIGN PATENT DOCUMENTS

EP 1359490 A2 11/2003
EP 1359490 A3 11/2003
JP 4-167010 6/1992
KR 0115143 12/2007
WO WO 2004/007719 2/2004

OTHER PUBLICATIONS

PCT/EP2008/051161 International Search Report and written opinion, May 16, 2008.
Chen, Wai-Kai, "The circuits and filters handbook", 2nd ed, CRC Press, 2003.
Cressler, John D., "Silicon Heterostructure Handbook", CRC Press-Taylor & Francis Group, 2006; 4.4-427-438.
Gray, Paul R., et al, *Analysis and Design of Analog Integrated Circuits*, Chapter 4, 4th ed., John Wiley & Sons, Inc., 2001, pp. 253-327.
Jianping, Zeng, et al, "CMOS Digital Integrated temperature Sensor", IEEE, Aug. 2005, pp. 310-313.
Banba et al, "A CMOS bandgap reference circuit with Sub-1-V operation", IEEE JSSC vol. 34, No. 5, May 1999, pp. 670-674.
Brokaw, A. Paul, "A simple three-terminal IC bandgap reference", IEEE Journal of Solid-State Circuits, vol. SC-9, No. 6, Dec. 1974, pp. 388-393.
Jones, D.A., and Martin, K., "Analog Integrated Circuit Design", John Wiley & Sons, USA, 1997 (ISBN 0-47L-L4448-7, pp. 353-363).
Malcovati et al, "Curvature-compensated BiCMOS bandgap with 1-V supply voltage", IEEE JSSC, vol. 36, No. 7, Jul. 2001.
Sudha et al, "A low noise sub-bandgap voltage reference", IEEE, Proceedings of the 40th Midwest Symposium on Circuits and Systems, 1997. vol. 1, Aug. 3-6, 1997, pp. 193-196.
Widlar, Robert J., "New developments in IC voltage regulators", IEEE Journal of Solid-State Circuits, vol. SC-6, No. 1, Feb. 1971, pp. 2-7.
PCT/EP2005/052737 International Search Report, Sep. 23, 2005.
PCT/EP2008/067402 International Search Report, Mar. 20, 2009.
PCT/EP2008/067403, International Search Report and Written Opinion, Apr. 27, 2009.
Pease, R.A., "The design of band-gap reference circuits: trials and tribulations", IEEE 1990 Bipolar circuits and Technology Meeting 9.3, Sep. 17, 1990, pp. 214-218.

* cited by examiner

REFERENCE CIRCUIT AND METHOD FOR PROVIDING A REFERENCE

CROSS REFERENCE TO RELATED APPLICATION

This application is a Continuation-in-part of U.S. application Ser. No. 11/529,723, filed on Sep. 25, 2006 which is now U.S. Pat. No. 7,576,598 issued on Aug. 18, 2009, which is hereby incorporated by reference in its entirety.

FIELD OF THE INVENTION

The present invention relates to reference circuits such as those providing voltage or current references. The invention more particularly relates to a voltage reference circuit and a method which provides a reference voltage output that is independent of the process variations.

BACKGROUND

Reference circuits may be provided in a number of different configurations. A typical bandgap voltage reference circuit is based on addition of two voltages having equal and opposite temperature coefficients.

FIG. 1 shows in schematic form an example of a known bandgap voltage reference. It consists of a current source, I1, a resistor, r1, and a diode, d1. It will be understood that the operation of the diode is equivalent to that of a forward biased base-emitter voltage of a bipolar transistor. The voltage drop across the diode has a negative temperature coefficient, TC, of about −2.2 mV/C and is usually denoted as a Complementary to Absolute Temperature, or CTAT voltage, as its output value decreases with increasing temperature. The current source I1 is desirably a Proportional to Absolute Temperature, or a PTAT source, such that the voltage drop across r1 is PTAT voltage. In this way as absolute temperature increases, the voltage output will also increase. The PTAT current is generated by reflecting across a resistor a voltage difference ($\Delta V_{be}$) of two forward-biased base-emitter junctions of bipolar transistors operating at different current densities. Such operation is well known in the art.

FIG. 2 represents in graphical form, the operation of the circuit of FIG. 1. By combining the CTAT voltage, V_CTAT, of d1 with the PTAT voltage, V_PTAT, resultant from the voltage drop across r1 it is possible to provide a relatively constant output voltage Vref over a wide temperature range—the two combine to provide a Vref which is substantially flat across temperature. However, in this arrangement there are two unknowns which must be combined in a prescribed configuration to provide the desired output. The first unknown is the CTAT voltage which is very strongly dependent on process parameters. The geometry of the corresponding junction and the difference in doping level have relatively large variations from lot to lot and die to die. These variations are reflected as changes in voltage drop across the diode both at 0K and at room temperature. Such variations can lead to inaccuracies in the resultant Vref. The voltage drop across the diode at 0K is called the bandgap voltage, denoted Eg0. If the PTAT and CTAT voltages are well matched, the value of the reference voltage will equal the bandgap voltage, Eg0. While not affected in the same manner by process variations as the CTAT voltage is, the PTAT voltage is also affected by various errors of the circuit, especially by offset voltages of the transistors and mismatches of the resistors.

There are different approaches to trim a bandgap voltage reference. The first method is to trim the reference at a so called "magic" value. An example of how this trimming method is achieved is illustrated in FIG. 3. This example assumes that the second order error, sometimes called the "curvature" error, which is inherently present in bandgap voltage references, is removed such that the reference voltage variation vs. temperature is a straight line. If the PTAT and CTAT voltages are well balanced (denoted by PTAT_0, CTAT_0), the reference voltage Vref_0, is equal to the diode's bandgap voltage, Eg_0, and it has zero temperature coefficient, TC. However, as mentioned above, due to the process variations used in the manufacturing process, the diode's bandgap voltage can change from Eg_0 to Eg_1 and the voltage drop across the diode changes from CTAT_0 to CTAT_1. If we assume that the PTAT voltage remains unchanged (PTAT_0=PTAT_1) the resulting voltage reference (Ref_1) at room temperature (T0) drops from Vref_0 and it also has a positive slope, i.e. the output is not constant across temperature. It will be understood that both changes are unwanted. To compensate for the drop in the value of the reference voltage Vref, the PTAT voltage can be trimmed at room temperature to provide the "magic" value for the reference voltage, Vref_0. To achieve this modification, the PTAT voltage is accordingly changed from PTAT_0 to PTAT_2. The resulting reference voltage (Ref_2) has the "magic" value only at room temperature but its TC is even worse. As a result it is evident that while this method can guarantee a nominal value at room temperature, it does not provide a satisfactory voltage reference as the temperature coefficient response is not good and the reference will therefore vary with varying temperatures.

An alternative technique is to utilise two trimming steps, at two different temperatures. At a first temperature, say room temperature, the reference voltage is measured. But because Eg_0 changes from die to die, this value is often different from the desired value. At a second temperature, usually a higher temperature, the reference is trimmed to the same value as it was at first temperature. This requirement to provide trimming to the same value as at the first temperature can be/addressed by use of a third trimming step to gain the resulting reference voltage to the desired value. As a result when a lot of prior art voltage references are trimmed at two different temperatures, an expensive tracking procedure is required to identify the part from the lot and its corresponding voltage value.

An example of a known more detailed CMOS bandgap voltage reference is presented on FIG. 4. Two parasitic substrate bipolar transistors, Q1 and Q2, are operating at different collector current density, usually by scaling of their emitter areas by an appropriate factor n. An amplifier A1 controls the common gate of three identical PMOS transistors, M1, M2 and M3 such that, from the supply line, three identical currents are forced and a voltage is generated at the Vref node. If the base current of the bipolar transistors (Q1, Q2) can be neglected and assuming an ideal amplifier A1, then the collector current density ratio is n and a base-emitter voltage difference is developed across r1:

$$\Delta Vbe = \frac{kT}{q}\ln(n) = \Delta V_{be0}\frac{T}{T_0} \tag{1}$$

Where:

k is the Boltzmann constant;

T is actual absolute temperature [° K.];

$T_0$ is the reference temperature, usually room temperature;

q is electronic charge;

$\Delta V_{be0}$ is the base-emitter voltage difference at room temperature.

This voltage has a typical slope between 0.2 mV/C to 0.4 mV/C and is usually amplified by a factor of 5 to 10 in order to balance the base-emitter voltage slope to generate the reference voltage as FIG. 2 and Eq.2 shows:

$$V_{ref} = V_{be}(Q3) + \frac{r_2}{r_1}\frac{kT}{q}\ln(n) \tag{2}$$

The resistor ratio $r_2/r_1$ represents the gain factor for $\Delta V_{be}$.

Such circuits based on a CMOS process generate a voltage having significant variations from die to die mainly due to MOS transistor offset voltages. It is also a noisy reference voltage as MOS transistors generate large noise, especially low frequency noise, compared to a bipolar based bandgap voltage reference. The main offset and noise contributor of the circuit according to FIG. 4 is transistor M2 as its errors are directly reflected on r1 and are amplified from r1 to the reference voltage by the resistor ratio.

Another drawback of a circuit in this configuration is its poor Power Supply Rejection Ratio—i.e., its ability to reject variation in the supply voltage.

A typical value of a bandgap voltage reference is about 1.25V. There is more demand for lower voltage references, such as 1V or 1.024V. These reference voltages are called "sub-bandgap" voltage references, as their value is less than a normally generated bandgap voltage reference.

One sub-bandgap voltage is described in "A CMOS Bandgap Reference Circuit with Sub-1-V Operation", Banba et al., *JSSC*, Vol. 34, No. 5, May 1999, pp. 670-674. This circuit can be derived from that of FIG. 4 by adding two resistors from the two amplifier's inputs to ground. As these two resistors are connected in parallel with a base-emitter voltage, a corresponding CTAT current is forced in each PMOS transistor connected at two inputs of the amplifier (M1 and M2 in FIG. 4). When the CTAT currents are balancing corresponding PTAT currents generated by the $\Delta V_{be}$ voltage, all PMOS mirrors will force constant currents including M3 which will force a constant voltage across a load resistor generating at the output node a temperature insensitive reference voltage.

Although this teaches the provision of a sub-bandgap reference it suffers in that the reference voltage is not corrected for the "curvature" error, which as was mentioned above is inherently present in such circuits due to second order effects. As a result it is difficult to trim it for a temperature coefficient of less than 15 ppm due to this curvature error. A modified version of this sub-bandgap voltage reference is presented on "Curvature Compensated BiCMOS Bandgap with 1V Supply Voltage", Malcovati et al., *JSSC*, Vol. 36, No. 7, July 2001.

Sub-bandgap voltage references such as those described in this publication are commonly denoted as "current mode" and are dependent on MOS transistors behaviour as the two components, PTAT and CTAT currents are separately generated and combined to generate the reference voltage across a resistor.

There are variants of "voltage mode" sub-bandgap voltage references based on adding fractions of base-emitter voltage to a corresponding PTAT component to generate temperature insensitive reference voltages. A sub-bandgap voltage reference is described in: "A low noise sub-bandgap voltage reference", Sudha, M.; Holman, W. T.; *Proceedings of the* 40*th Midwest Symposium on Circuits and Systems,* 1997. Volume 1, 3-6 Aug. 1997, pp. 193-196. This reference circuit generates a low reference voltage as a base-emitter voltage difference of two bipolar transistors operating at different current densities. The base-emitter difference is subtracted via a resistor divider. As it stands this circuit cannot be implemented in a low cost CMOS process. In order to use the reference voltage this circuit has to be followed by a gain stage. Because the reference voltage value is about 200 mV usually it needs to be amplified to 1V or more. By amplifying the reference voltage the errors of both the reference circuit and the amplifier will increase in proportion to the gain factor. This is not ideal.

A curvature-corrected sub-bandgap voltage which can be implemented on a CMOS process is described in U.S. Pat. No. 7,253,597 of A. Paul Brokaw, co-assigned to the assignee of the present invention. This circuit is based on a combination of two bipolar transistors, four resistors, an amplifier and three PMOS transistors and generates a constant current and a temperature independent voltage across a load resistor. As with other MOS variants this reference is also very much affected by offset and noise of MOS transistors.

A CMOS bandgap voltage reference was disclosed in "A method and a circuit for producing a PTAT voltage and a method and a circuit for producing a bandgap voltage reference" U.S. Pat. No. 7,193,454, co-assigned to the assignee of the present invention). In order to reduce offset and noise sensitivity due to MOS current mirrors, this circuit is based on a combination of two amplifiers, the first generating an inverse PTAT voltage and the second generating a reference voltage by mixing a base-emitter voltage of a bipolar transistor and the output voltage of the first amplifier. This circuit offers a low offset voltage and does not suffer from noise sensitivity arising from MOS current mirrors but suffers in that these benefits are achieved by increasing the circuit complexity.

The problems associated with such bandgap reference circuits are exemplary of the type of problems encountered in all reference circuits.

SUMMARY

These and other problems associated with the prior art are addressed by a reference circuit in accordance with the teachings set forth herein. Such a circuit is based on the generation of a component which has a proportional to temperature dependency, a PTAT component. This PTAT component may be combined with a circuit component which has an inverse to temperature dependency, a CTAT component. The combination of the PTAT with the CTAT components can be used to eliminate the slope of the CTAT component without contributing to the absolute value of the resultant reference output.

A circuit in accordance with these teachings provides a first set of circuit elements whose output below a first temperature is a PTAT output of a first polarity and above that first temperature is a PTAT output of a second polarity (such polarities being referenced to zero). By judiciously selecting the temperature at which the PTAT output changes polarity the contribution of the PTAT output to the overall value of the reference can be minimized. It will be understood that in a conventional integer scale having both negative and positive values separated by a zero value, a positive value is greater than zero and a negative value is less than zero. It will be appreciated that a positive value is opposite in polarity to a negative value, and vice versa.

These and other inventive features will be understood with reference to the exemplary embodiments which follow.

BRIEF DESCRIPTION OF THE DRAWINGS

Example embodiments for practicing these teachings will now be described with reference to the accompanying drawings in which.

DETAILED DESCRIPTION OF THE DRAWINGS

The prior art has been described with reference to FIGS. 1, 2, 3 and 4. Exemplary and non-limiting implementation of embodiments for practicing aspects of the inventive concepts will now be described with reference to FIGS. 5 to 16.

The present teaching addresses the problem of prior art arrangements by reducing the number of unknown variables in a circuit in order to provide a more accurate voltage reference which is not dependant on process variations.

Figure 1:
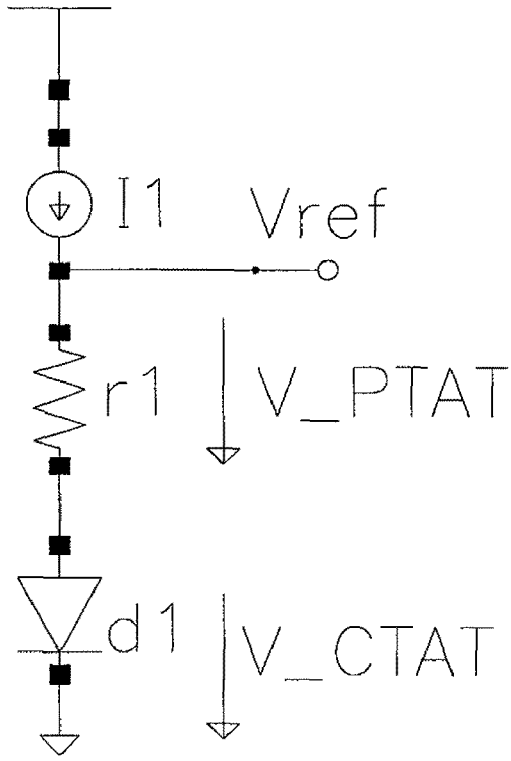
Fig.1 (PRIOR ART)
FIG. 1 is a schematic showing a known bandgap voltage reference circuit.
Figure 2:
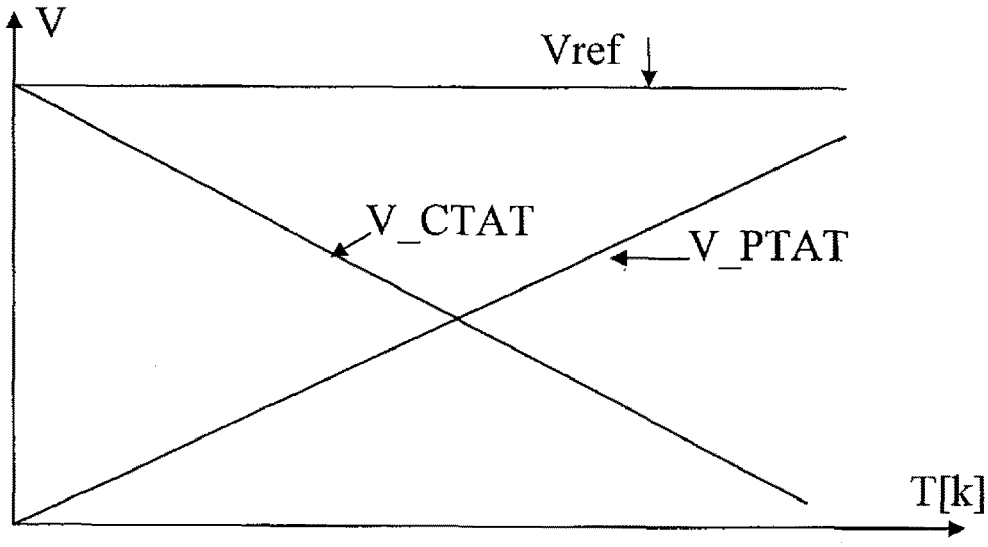
Fig.2 (PRIOR ART)
FIG. 2 shows graphically how PTAT and CTAT voltages generated through the circuit of FIG. 1 may be combined to provide a reference voltage.
Figure 3:
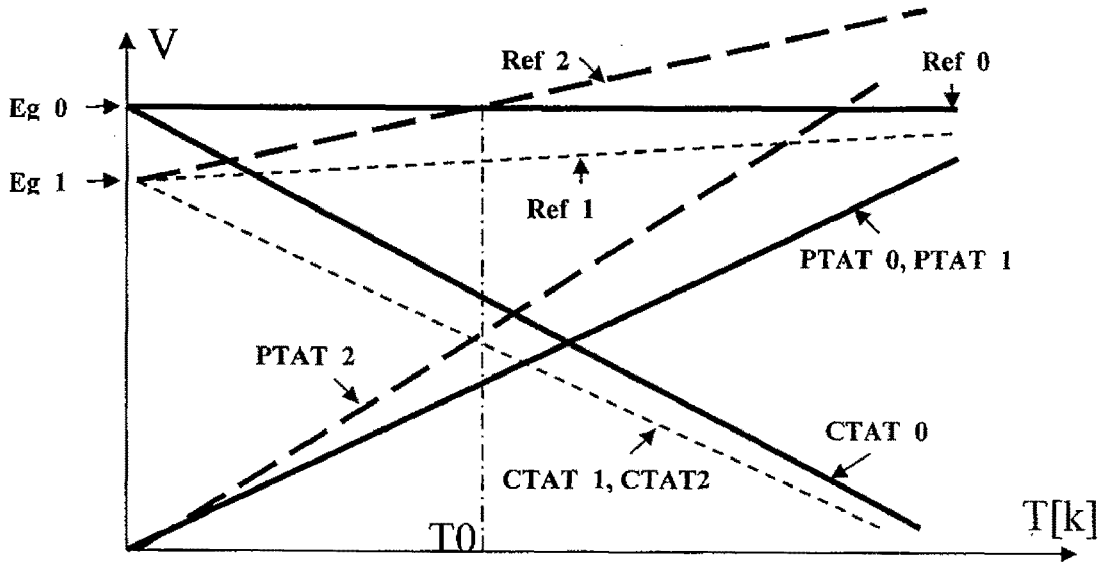
Fig.3 (PRIOR ART)
FIG. 3 illustrates how a typical bandgap voltage reference is trimmed for a "magic" voltage at one temperature.
Figure 4:
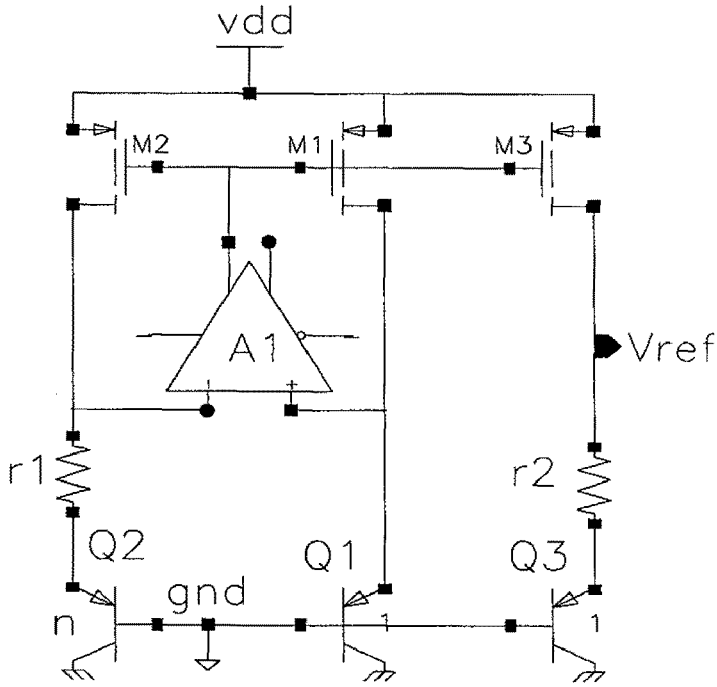
Fig.4 (PRIOR ART)
FIG. 4 is an example of a known CMOS circuit for providing a bandgap voltage reference.
Figure 5:
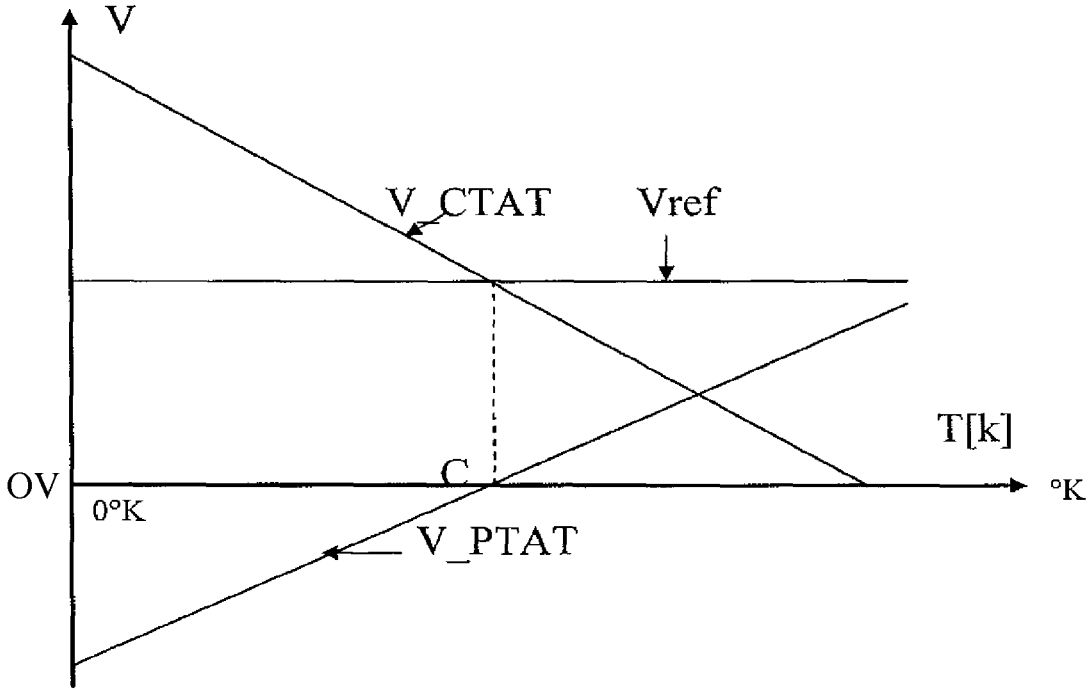
FIG. 5 shows graphically how a circuit in accordance with the teaching of the invention may be used to combine a shifted PTAT voltage and a CTAT voltage to provide a reference voltage.

FIG. 5 provides a graphical representation of how circuit components or elements of a circuit in accordance with the current teaching may be combined to provide a reference voltage. In this arrangement there is provided a compensation for the slope contributed by the complimentary to absolute temperature voltage component (V_CTAT component) by removing that slope as opposed to the prior art arrangement where it was compensated by addition of a corresponding proportional to absolute temperature (PTAT) voltage. The present teaching provides for the generation of a shifted PTAT voltage, V_PTAT, which is negative below a first temperature, typically room temperature, and positive above that temperature. By the phrase "shifted", it will be understood that the polarity of the output changes as that voltage passes through a selected temperature value. In this way if one examines the PTAT voltage of FIG. 5, it will be observed that the PTAT voltage has been shifted downward on the Y axis as compared to that of FIG. 2, a portion of the voltage output has a negative polarity whereas the rest has a positive polarity. Within this context it will be noted that the integer values of the voltage may be the same, but the sign of that voltage may be different. For example a positive 3V (+3V) has the same integer value as a negative 3V(−3V) signal, but is opposite in polarity to that voltage. In FIG. 2, the PTAT voltage had a positive polarity. The cross-over-point chosen may be pre-selected by the user. In the arrangement of FIG. 5 that cross-over-point, point C, can be used to minimize the PTAT contribution to the value of the resultant voltage reference, Vref. The cancelling of the effect of one of the two unknown parameters and then the adjustment of that unknown to a precise value enables the provision of an accurate voltage reference, which in this arrangement is provided as a sub-bandgap voltage reference.

It will be understood from an examination of FIG. 5 that the PTAT voltage generated has a polarity at absolute zero that is opposite that of the corresponding CTAT voltage. In known architectures, the PTAT and CTAT voltages have the same polarity (a positive polarity). The present invention provides for a generation of a PTAT voltage that has a first polarity at a first temperature and the opposite polarity at a second temperature, the second temperature being greater than the first temperature. In this way, the PTAT voltage generated undergoes a transition or crossover where its polarity will change. The location of this crossover is used, in accordance with the teaching of the invention to affect the absolute value of the reference voltage generated.

It will be further understood that the point of crossover of the PTAT voltage is used to select the absolute value of the CTAT voltage that will form the basis of the reference output. Unless the crossover point is absolute zero, this CTAT value will be less than a bandgap voltage. Unless this value is then amplified or scaled in some other fashion the resultant reference voltage will be a value less than a bandgap voltage, i.e. a sub-bandgap voltage reference.

Figure 6:
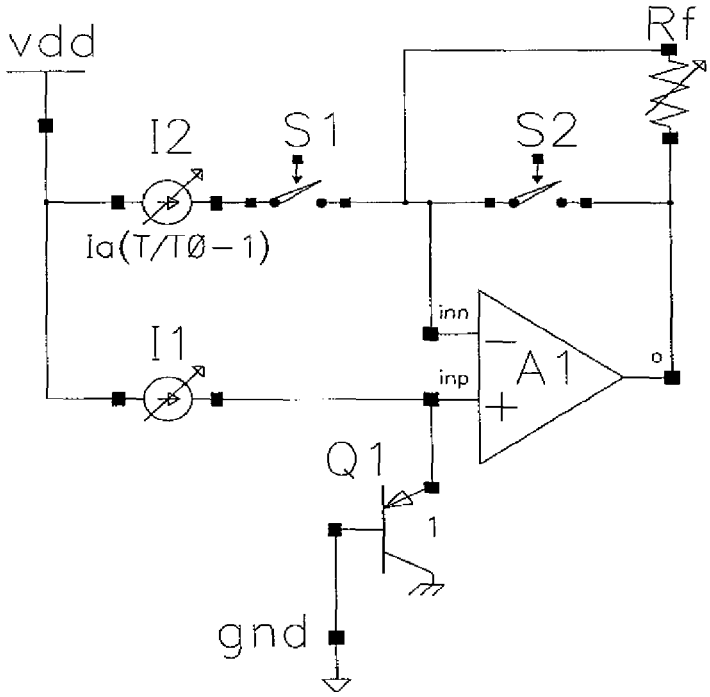
FIG. 6 shows an implementation of a bandgap voltage reference circuit in accordance with the teaching of the invention.

FIG. 6 shows in an exemplary fashion how such a combination of PTAT and CTAT voltages may be realized. It will be appreciated that this is provided as a generic implementation of a sub-bandgap voltage reference, in accordance with the teaching of the invention but it is not intended to limit the invention to such an arrangement. This circuit includes a substrate forward-biased bipolar transistor Q1 whose base-emitter voltage is a CTAT voltage, two current sources, I1, I2, an amplifier, A1, a resistor Rf and two switches, S1, S2. The current I1 is typically a PTAT current. The current I2 is a shifted PTAT current such that its output is zero at a pre-selected temperature value, which will typically be the reference (or room) temperature, $T_0$. In normal operation S1 is closed and S2 is open. As a result, assuming that the amplifier has no offset voltage, the amplifier's output voltage will be the voltage drop of Q1 plus the feedback voltage drop across Rf due to the input current I2. For a given I2 current there is only one value of Rf for which the temperature slope of Q1 is completely compensated by the shifted voltage drop across Rf, thus making the amplifier's output voltage temperature insensitive. This voltage is the voltage drop of Q1 at temperature T0 since the feedback current is zero at T0. At temperature T0 the reference is trimmed in two steps.

1) First, for S1 open and S2 closed the output voltage of the amplifier is measured. The corresponding voltage will be the reference voltage. If this value is different from the desired value the current I1 is to be adjusted accordingly.
2) Second, S1 is closed and S2 is open and I2 is trimmed to zero such that the reference voltage value remains the desired value. At this stage the reference is trimmed only for absolute value at T0. For temperature coefficient (TC) with S1 closed and S2 is open, the reference voltage is trimmed at a different temperature, usually a higher temperature, by trimming Rf until the reference voltage remains the desired voltage. As a result of this trim procedure, the reference voltage variation vs. temperature is a straight line with two equal values at two different temperatures, the reference is temperature insensitive.

A very important feature of this reference circuit is that it is no longer dependent on the process used to fabricate the components of the circuit. The desired output value is under control as compared to the typical bandgap voltage reference, described previously with reference to the background, which is based on summation of two voltages with opposite TC where the "magic" voltage varies with the process.

It will be appreciated that the present teaching overcomes the problem of the two unknown parameters which were present in the prior art arrangement by forcing the base emitter voltage $V_{be}$ of the diode to a desired value that is process independent and then using that value as the determining value for the remainder of the calibration steps. The desired voltage reference can either be a base-emitter voltage, a gained replica or an attenuated replica of this voltage.

It will be understood that the circuit and methodology rely on the provision of a shifted PTAT voltage or current. There are different arrangements or configurations that could be used to generate a shifted PTAT current through the feedback resistor of FIG. 6. While any one of these arrangements could be implemented within the context of the present teaching, it is preferred to generate this current without using current mirrors as such mirrors may introduce errors in the output.

Figure 7:
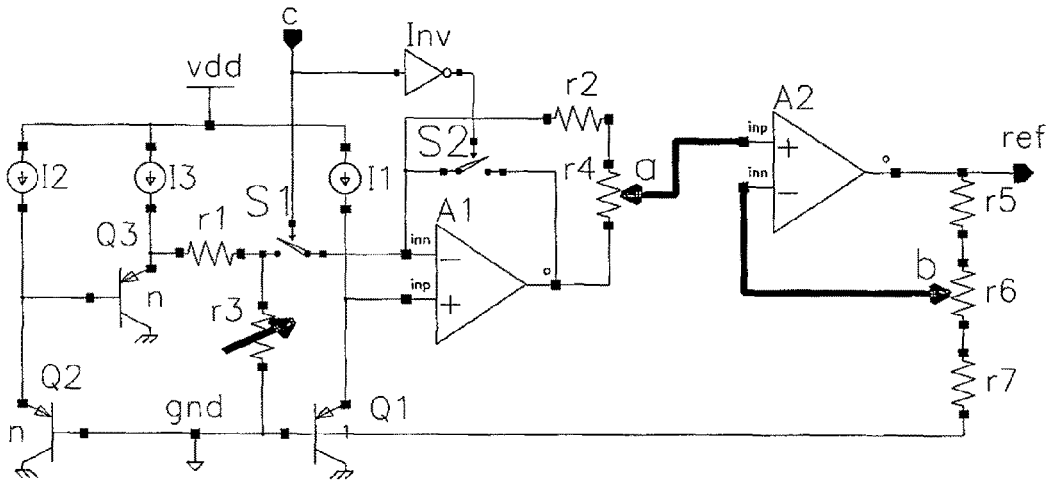
FIG. 7 shows another implementation of the circuit according to FIG. 6, which is configured to provide a buffered output.

FIG. 7 shows an arrangement based on that presented in FIG. 6 which provides a sub-bandgap voltage reference at a node "a" and a desired or buffered reference voltage at a node "ref" neither of which are sensitive to process variations. It can be considered as being formed from a first and second set of circuit elements. The first set of elements provide the sub-bandgap voltage reference basic circuit and consists of three bipolar transistors, Q1, Q2 and Q3; two fixed value resistors, r1,r2; two variable resistors r3, r4; an operational amplifier A1, three current sources, I1, I2 and I3, two analog switches, S1, S2 and a logic inverter, Inv. Preferably Q1 is a unity area emitter substrate bipolar transistor, Q2 and Q3 are each an area of n parallel unity emitter substrate bipolar transistors; I1 and I2 are PTAT (proportional to absolute temperature) currents and I3 is preferably a CTAT (complimentary to absolute temperature) current. By providing a bipolar transistor at the non-inverting input and a stack of two bipolar transistors via a resistor, r1, at the inverting input of the amplifier, the feedback current resultant is a difference of two currents, one CTAT and one PTAT. The resistor r3 has the role of forcing the feedback current to zero at a specific temperature. In this way the current of the form $T/T_0-1$ which was shown in FIG. 5 is being generated through the feedback resistor Rf. A current of this form has an output whose relationship with temperature is defined by $T/T_0-1$. By trimming R3 it is possible to adjust the crossover point where the feedback current will changes its polarity. The variable resistor r4 can be trimmed to adjust the temperature coefficient (TC) response of the circuit.

As the voltage at the node "a" is related to the base emitter voltage of transistor Q1, it will be understood that the presence of a single transistor Q1 at the non-inverting node results in a sub-bandgap voltage being generated at this node.

The second set of circuit elements which provides the remainder of the circuit, is designed to generate a desired or buffered reference voltage from the output of the first set of circuit elements taken from node "a". This buffered output at a node "ref" is generated by circuit components including an amplifier A2 and three resistors, r5, r6, r7, where r5 and r7 are fixed resistors and r6 is a variable resistor, all provided in a negative feedback configuration coupled to the inverting node of amplifier A2. The node "a" is coupled to the non-inverting input of A2. A logic signal C will allow for the operation of the circuit in "test" mode, for C=1, when S1 is open and S2 is closed and in "normal" mode, for C=0, when S1 is closed and S2 is open. It will be understood that the trimming of resistor r6 may be used to scale the amplification of the output of the first set of circuit elements but that alternatively the emitter of Q1 could be forced to a desired value by replacing current source I1 with a variable current source-similar to what was shown in FIG. 6.

Examples of the types of circuitry that may be used to provide the PTAT and CTAT current generators are well known to those skilled in the art.

The sub-bandgap voltage reference output is a combination of the base-emitter voltage of Q1, plus the voltage drop across the feedback resistors from the inverting node of A1 to the tapping node, "a".

The base-emitter voltage of a bipolar transistor has a temperature variation according to (3):

$$V_{be} = V_{G0}\left(1-\frac{T}{T_0}\right) + V_{be0}\frac{T}{T_0} - \sigma\frac{kT}{q}\ln\left(\frac{T}{T_0}\right) + \frac{kT}{q}\ln\left(\frac{I_c}{I_{c0}}\right) \tag{3}$$

Here $V_{G0}$ is base-emitter voltage at 0K, which is of the order of 1.2V; $V_{be0}$ is base-emitter voltage at room temperature; $\sigma$ is the saturation current temperature exponent; $I_c$ is the collector current at temperature T and $I_{c0}$ is the same current at a reference temperature $T_0$. It will be understood that the first two terms in (3) show a linear drop in temperature and the last two a nonlinear variation which is usually called "curvature" voltage. The two curvature terms can be combined into a single one, depending on the temperature variation of the collector current.

Assuming that the collector currents of Q1 and Q2 are PTAT currents of the same value and collector current of Q3 is a CTAT current having at room temperature ($T_0$) the same value as Q1 and Q2 then the base-emitter voltages for the three bipolar transistors are:

$$V_{be}(Q1) = V_{G0}\left(1-\frac{T}{T_0}\right) + V_{be10}\frac{T}{T_0} - (\sigma-1)\frac{kT}{q}\ln\left(\frac{T}{T_0}\right) \tag{4}$$

$$V_{be}(Q2) = V_{G0}\left(1-\frac{T}{T_0}\right) + V_{be20}\frac{T}{T_0} - (\sigma-1)\frac{kT}{q}\ln\left(\frac{T}{T_0}\right) \tag{5}$$

$$V_{be}(Q3) = V_{G0}\left(1-\frac{T}{T_0}\right) + V_{be30}\frac{T}{T_0} - (\sigma+c)\frac{kT}{q}\ln\left(\frac{T}{T_0}\right) \tag{6}$$

Here $V_{be10}$, $V_{be20}$, $V_{be30}$, are the corresponding base-emitter voltage at reference or room temperature, $T_0$, and c is an approximation coefficient equal to zero for constant current, −1, for PTAT current as (4) and (5) show, and about 0.8 for CTAT current.

As Q2 and Q3 have n times larger emitter area compared to Q1 at $T_0$, the base-emitter voltage differences are:

$$V_{be10} - V_{be20} = V_{be10} - V_{be30} = \frac{kT_0}{q}\ln(n) = \Delta V_{be0} \tag{7}$$

At temperature T0 the feedback current is forced to zero by trimming r3. As a result the voltage at the sub-bandgap voltage reference is $V_{be10}$. This condition sets up the ratio of $r_3$ to $r_1$ as equation (8) shows:

$$\frac{r_3}{r_1} = \frac{V_{be10}}{V_{be10} - 2\Delta V_{be0}} \tag{8}$$

The sub-bandgap voltage reference is:

$$V_{ref} = A * V_{G0} - B * \frac{T}{T_0} - D * \frac{KT}{q}\ln\left(\frac{T}{T_0}\right) \tag{9}$$

Where A is the bandgap voltage multiplication coefficient, B is temperature linear coefficient and D is "curvature" coefficient. These coefficients are:

$$A = 1 + \frac{r_2}{r_3} - \frac{r_2}{r_1} \tag{10}$$

$$B = (V_{G0} - V_{be10})\left(1 + \frac{r_2}{r_3} - \frac{r_2}{r_1}\right) - 2\Delta V_{be0}\frac{r_2}{r_1} \tag{11}$$

$$D = (\sigma - 1) * \left(1 + \frac{r_2}{r_3}\right) - (\sigma + c) * \frac{r_2}{r_1} \tag{12}$$

In order to force a reference voltage to be temperature insensitive, B has to be set to zero. From (8) and (11) for B=0 we get:

$$\frac{r_2}{r_1} = \frac{V_{be10} * (V_{G0} - V_{be10})}{2\Delta V_{be0} * V_{G0}} \tag{13}$$

The ratio of $r_2$ to $r_3$ can be found from (8) and (13):

$$\frac{r_2}{r_3} = \frac{(V_{be10} - 2\Delta V_{be0}) * (V_{G0} - V_{be10})}{2\Delta Vbe0 * V_{G0}} \tag{14}$$

For a submicron CMOS process $V_{g2}$ is about 1.205V; the base-emitter voltage of a forward biased bipolar transistor at room temperature is about $V_{be10}$=0.7V; a typical $\Delta V_{be0}$ voltage at room temperature is about 0.1V; typical value for σ is 3.8.

For these values the required resistor ratios are:

$$\frac{r_2}{r_1} = 1.47;\ \frac{r_3}{r_1} = 1.4;\ \frac{r_2}{r_3} = 1.048; \tag{15}$$

Also the coefficient "c" for D=0, (12), is c=0.9, which indicates the right choice for biasing Q3 with CTAT current in order to compensate for "curvature" error. In this way it will be understood that the voltage output includes an inherent curvature correction element.

While implementations have been described heretofore with reference to the generation of sub-bandgap voltage references it will be understood that the teaching herein can be also used for other references, be those current or voltage, where it is desired to provide an output which is based on the combination of known parameters.

Figure 8:
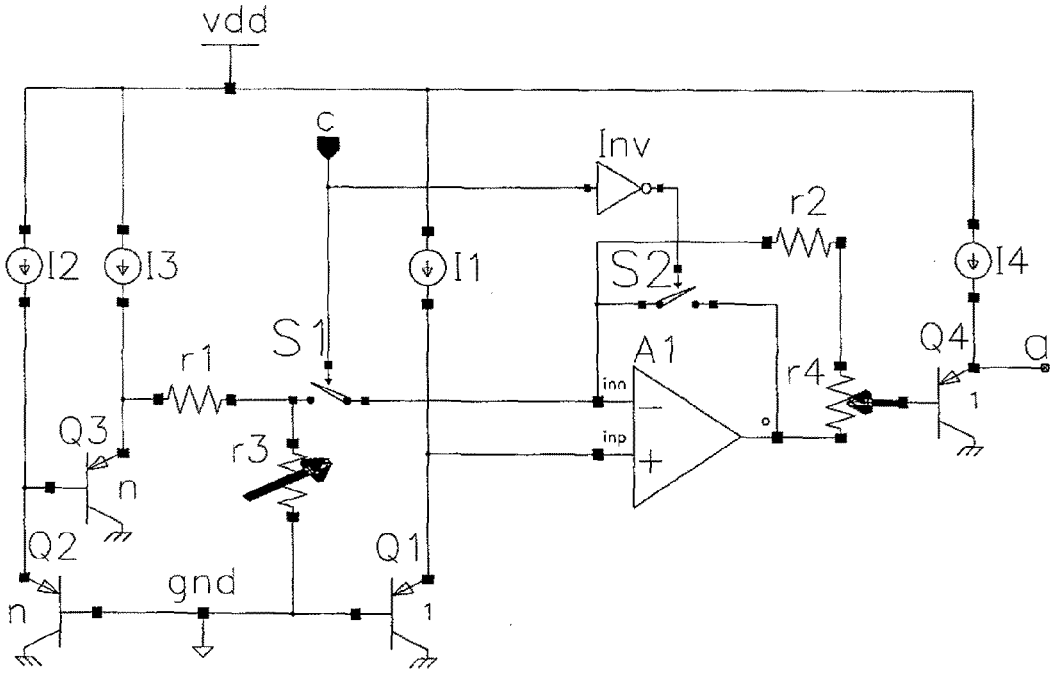
FIG. 8 shows how the circuit of FIG. 7 could be modified to generate an output having a value greater than 1 bandgap voltage.

Such an arrangement is shown in FIG. 8, which is a modification of the arrangement of FIG. 7. In this arrangement a further base emitter voltage is generated at the output of amplifier A1, by coupling a bipolar transistor Q4 to resistor r4. The emitter of Q4 is connected to current source I4. By coupling the base of Q4 to the resistor r4 and changing accordingly the feedback resistor Rf, and the tapping node "a" to the emitter node of the transistor it is possible to provide at that node a voltage whose output is twice $V_{be}$.

Figure 9:
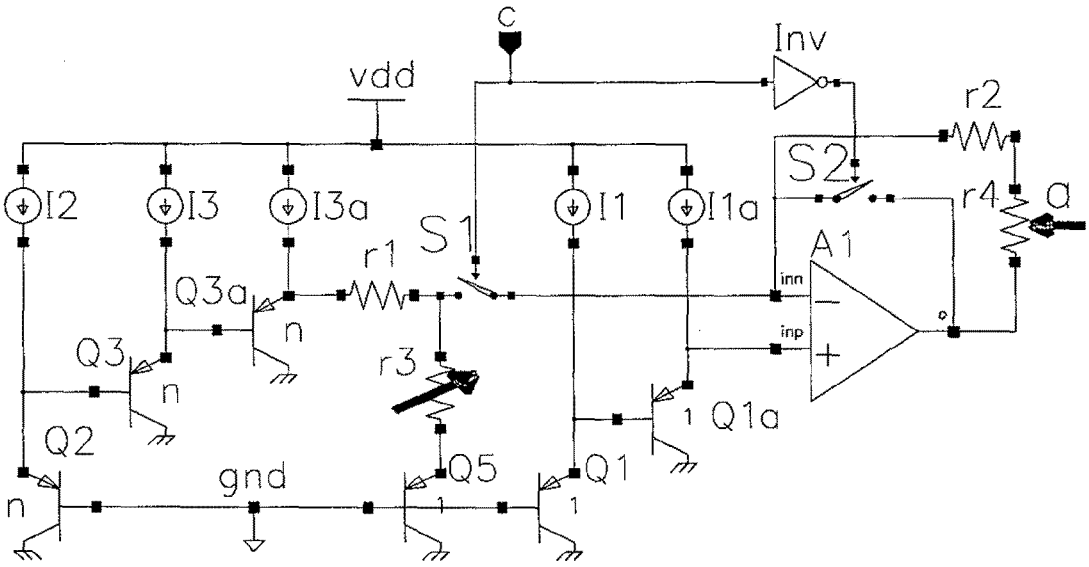
FIG. 9 shows an alternative circuit to FIG. 8.

Another way to generate the multiple bandgap voltage at node "a" is shown in FIG. 9. In this configuration, transistors Q1 and Q3 are provided as a stack arrangements (Q1, Q1*a*, Q3, Q3*a*, where Q1*a* and Q3*a* represents a single or multiple transistors) coupled to the non-inverting node of amplifier A1. The emitter of Q1*a* is connected to current source I1*a*. The emitter of Q3*a* is connected to current source I3*a*. By providing a stack arrangement, the $V_{be}$ generated is a multiple of a single $V_{be}$, which means that the resultant output at node "a" can be generated as a multiple sub-bandgap voltage. Here Q5 is compensating the stacked Q1*a* such that only one base-emitter voltage is reflected across R3 and thus R3 remains reasonably small in value, thus saving area. This arrangement has the advantage that the power supply rejection ratio is improved when compared to prior art arrangements and also is generated using less unknown parameters.

The circuit of FIG. 9 needs a larger supply voltage compared to the circuits of FIG. 7 and FIG. 8 but is less sensitive to the amplifier's offset voltage as a larger ΔVbe is generated from two base-emitter voltages of high current density to the corresponding three base-emitter voltages of low current density.

Figure 10:
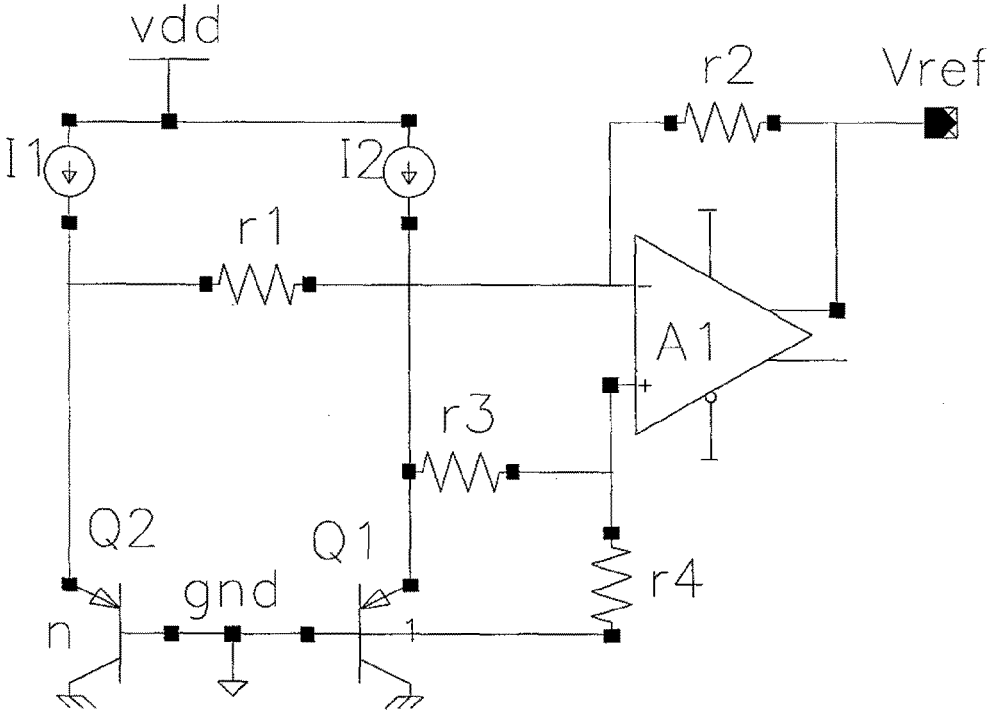
FIG. 10 shows a modification to the circuit of FIG. 7 for operation at very low supply voltage.

FIG. 10 shows a sub-bandgap voltage reference which is able to operate at very low supply voltage. Here the non-inverting input of the amplifier A1 is connected to a fraction of the base-emitter voltage of the Q1 which is the high current density bipolar transistor. The inverting input of the amplifier A1 is connected via r1 to the emitter of Q2 operating at low current density. FIG. 10 may be used to provide more flexibility than that available using the configurations of FIG. 6 or FIG. 7 as the non-inverting input of the amplifier can be set to any value less than a base-emitter voltage. If r3=r4, then the voltage contributed from Q1 is half that of FIG. 6 and the reference voltage will be scaled down accordingly.

Figure 11:
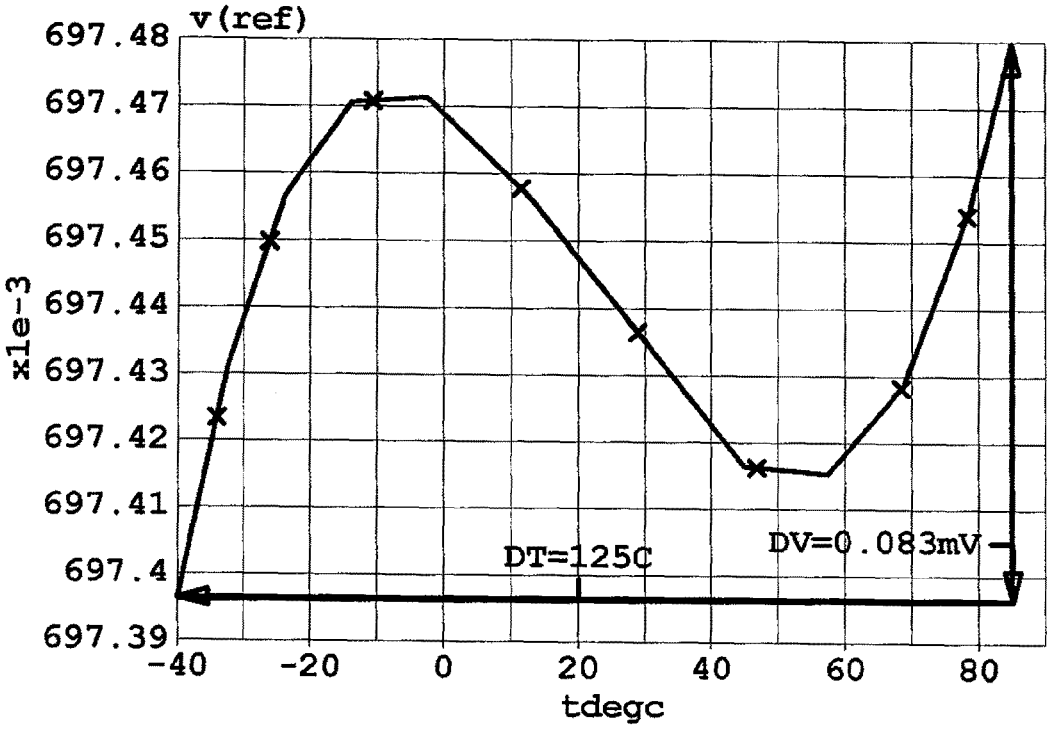
FIG. 11 shows simulated results for the performance of a circuit implemented according to the example of FIG. 7.

FIG. 11 shows results for a simulated sub-bandgap voltage reference according to the circuit of FIG. 7 for: unity emitter substrate bipolar Q1 biased with PTAT current of 8 uA at room temperature, Q2 with an emitter area of 31 compared to Q1 and biased with PTAT current of 3 uA at room temperature, Q3 with an emitter area of 31 compared to Q1 and biased with CTAT current of 4.2 uA at room temperature.

As the simulation shows the reference voltage has a variation of about 83 uV for the industrial temperature range (−40 C to 85 c) which corresponds to a temperature coefficient (TC) of less than 1 ppm/C degree.

As will be apparent to those skilled in the art, a buffered reference voltage with a desired value will be provided at the "ref" node by trimming r6 so as to achieve the desired value, or as mentioned above by forcing the emitter of Q1 to a desired value.

Figure 12:
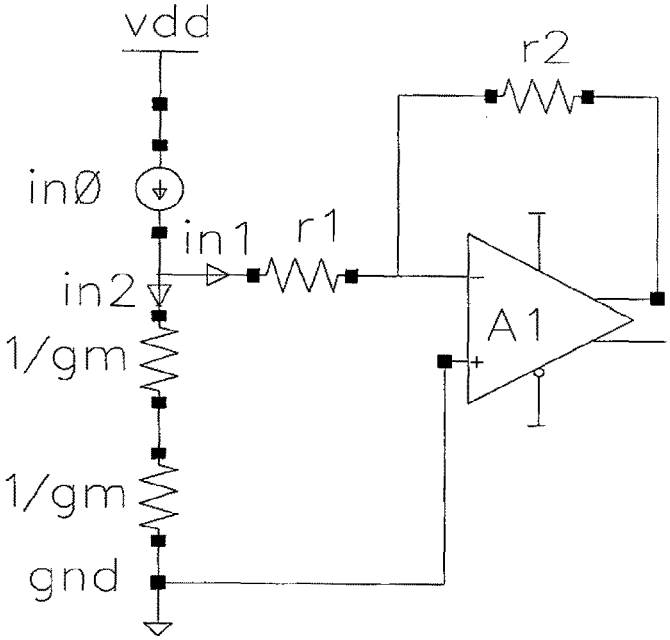
FIG. 12 is an equivalent circuit of FIG. 7 for the purpose of calculation the noise and supply voltage sensitivity.

FIG. 12 is a model schematic for the sub-bandgap voltage reference circuit of FIG. 7 (with r3 omitted) for the purpose of demonstrating how the sub-bandgap voltage reference circuit in accordance with the teaching of the invention reacts to offset voltage and noise injected from PMOS mirrors. As was evident from an examination of FIG. 7, the current sources I2 and I3 are coupled to Vdd and hence could be affected by noise on that line. The simplified arrangement presented in FIG. 12 is useable to ascertain the effect of that noise. In this schematic, in0 is a current source corresponding to the offset or noise current of I3 injected through a PMOS mirror; r1 and r2 are the same resistors as in FIG. 7; Q2 and Q3 from FIG. 7 are replaced by their resistors, 1/gm.

As the impedance through the two 1/gm resistors is less than that through r1, the noise current, in0, is mainly dumped to ground via the two 1/gm resistors. Assuming at room temperature the currents through r1 and Q2 and Q3 have the same value then the ratio of the current injected into the amplifier's non-inverting node, in1, to the total noise current in0 is:

$$\frac{in_1}{in_0} = \frac{\frac{2}{g_m}}{\frac{2}{g_m} + r1} = \frac{2 * Vt_0}{2 * Vt_0 + V_{be0} - 2 * \Delta V_{be0}} = \frac{2 * 0.026}{2 * 0.026 + 0.7 - 2 * 0.1} = 0.094 \quad (16)$$

Here $Vt_0$ is $kT_0/q$, or thermal voltage, of 26 mV at T=300K. As Equation (16) shows more than 90% of the noise injected from PMOS mirrors is dumped to ground through Q2 and Q3 and less than 10% is diverted to the amplifier's inverting node such that the reference voltage is desensitized to the supply voltage variation and current mirror mismatches and noise.

While exemplary implementations have been described heretofore with reference to the generation of bandgap voltage references it will be understood that these are provided to assist in an understanding of the present teaching and it is not intended to limit application of the benefits of the present teaching to such bandgap implementations. It will be appreciated and understood that where it is desired to provide an output which is based on the combination of known parameters, such an output may be implemented without using the specifics of bandgap circuitry.

Figure 13:
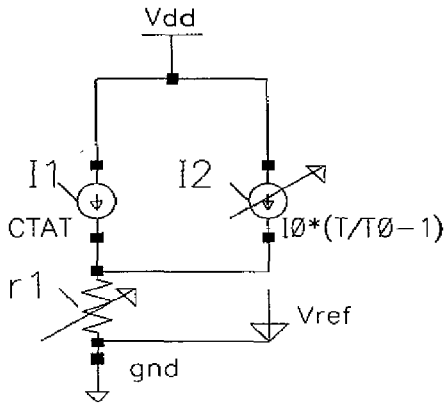
FIG. 13 is a schematic circuit diagram of an exemplary voltage reference circuit.

Referring now to FIGS. 13 to 16 exemplary circuits which are not of a bandgap type are described. FIG. 13 shows a schematic circuit of an exemplary current mode reference circuit which includes a pair of current sources I1 and I2 and a resistor r1. The current sources I1 and I2 are arranged in parallel between a positive supply voltage node Vdd and one end of the resistor r1. The other end of the resistor r1 is coupled to ground. The current sources I1 and I2 share a common node with r1 such that current I1 and current I2 flow through r1 to ground. A reference voltage Vref is developed across r1. I1 is configured to provide a CTAT current and I2 configured to provide a current of the form:

$$I_0 * \left(\frac{T}{T_0} - 1\right) \quad (17)$$

Wherein:

$T_0$ is a reference temperature, and

T is a second temperature, typically a temperature commensurate with operating conditions of the circuit.

It will be understood that if the output of the current source I2 is zero at the reference temperature $T_0$, it will adopt a negative form for temperatures T less than the reference temperature, i.e. in instances where $T<T_0$. Similarly the output will adopt a positive form for temperatures greater than the reference temperature, i.e. $T>T_0$.

At the reference temperature $T_0$, the current source I1 forces a CTAT current through the resistor r1. As I2 is zero at the reference temperature the only current which flows through r1 is I1. Thus, at the reference temperature $T_0$, the reference voltage Vref corresponds to the voltage drop across r1, i.e., $$\text{Vref}=r1*I1 \quad (18)$$

It will therefore be appreciated that the value of the reference voltage Vref may be set to a desired value at the reference temperature $T_0$, by trimming the value of r1 or the varying the current I1.

At the second temperature, T, the current output of I2 is no longer zero. As a consequence, the reference voltage is related to a sum of the two currents I1 and I2, as reflected across the resistor r1, i.e., $$\text{Vref}=r1*(I1+I2) \quad (19)$$

At the second temperature, T, judicious selection of the current provided by I2, allows the voltage reference, Vref, to have the same value at the second temperature as it was at the reference temperature. By choosing current sources that provide an output having a linear variation relative to temperature it will be appreciated that Vref remains temperature insensitive at the second temperature.

Figure 14:
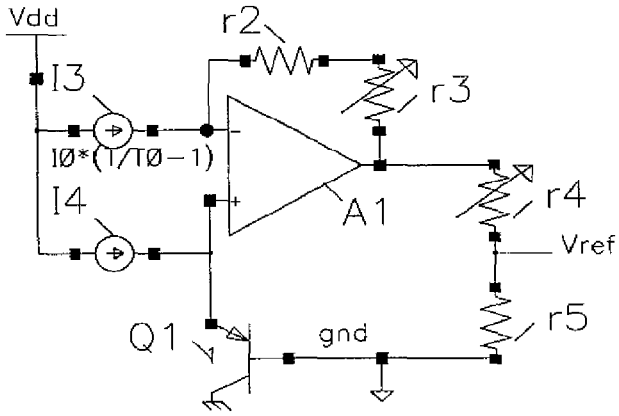
FIG. 14 is a schematic circuit diagram of an exemplary voltage reference circuit.

Referring now to FIG. 14 which shows another exemplary voltage reference circuit which includes an op-amp A1, a diode configured bipolar transistor Q1, a pair of current sources I3 and I4, and four resistors r2, r3, r4 and r5. The collector and base of the bipolar transistor Q1 are coupled to ground. The emitter of bipolar transistor Q1 is biased with a current I4, preferably having a PTAT form, such that at the non-inverting input of the amplifier A1 a CTAT voltage is generated. A second current I3 injected into the inverting node of A1 and is of the form of.

$$I_0 * \left(\frac{T}{T_0} - 1\right) \quad (20)$$

Wherein:

$I_0$ is a current value, $T_0$ is a reference temperature, and

T is a second temperature.

It will be understood that if the output of the current source I3 is chosen to be zero at the reference temperature $T_0$, it is negative for temperatures less than this reference temperature, i.e. $T<T_0$, and positive for temperatures greater than this temperature, i.e. $T>T_0$. A feedback path is provided between the inverting input of the op-amp A1 and the output of op-amp A1. The feedback path includes two resistors: a first, r2, having fixed value and a second, r3, being trimmable.

A resistor divider which includes two resistors r4 and r5 is provided between the output of the op-amp A1 and ground. At the reference temperature, $T_0$, the reference voltage Vref is set to a desired value via the resistor divider. At this temperature it will be appreciated from the above discussion that the output of I3 is zero and as such it does not contribute to Vref. At the second temperature, T, the magnitude of I3 is no longer zero and as a consequence I3 contributes to Vref. At the second temperature T, the feedback resistor r3 may be trimmed so that Vref is the same at the second temperature as it was at the reference temperature. In a similar fashion to that described with reference to FIG. 13, as both currents I3 and I4 have linear variations versus temperature, the reference output of the circuit, Vref, remains temperature insensitive at the second temperature.

Figure 15:
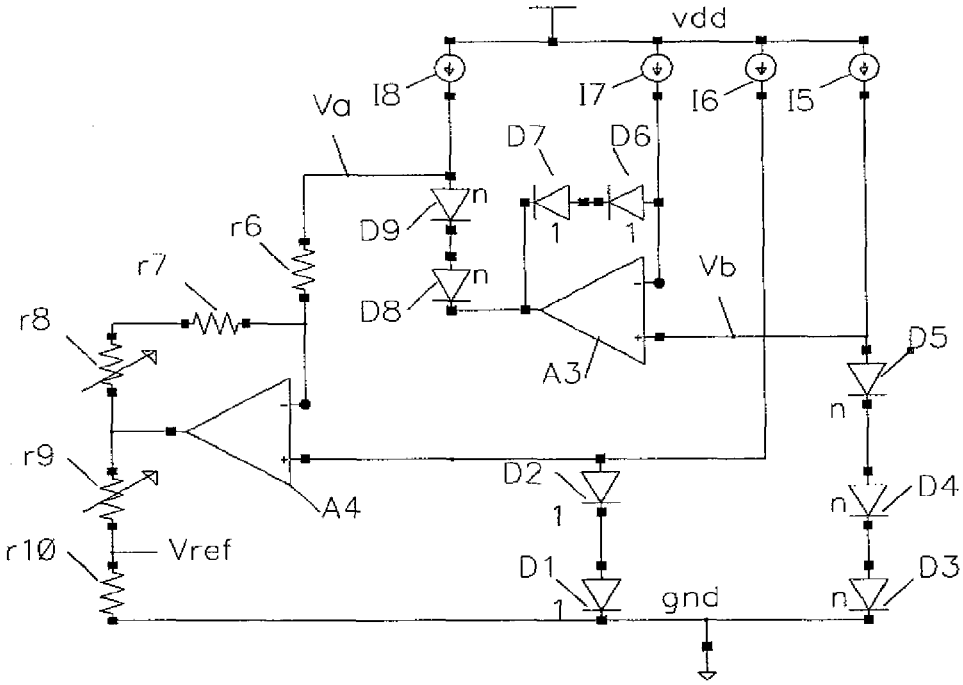
FIG. 15 is a schematic circuit diagram of an exemplary voltage reference circuit.

Referring now to FIG. 15 there is provided another exemplary voltage reference circuit. This circuit is configured to generate a current in the form of:

$$I_0 * \left(\frac{T}{T_0} - 1\right) \tag{21}$$

from a combination of multiple base-emitter voltage differences. The circuit comprises two amplifiers, A3, A4, five resistors, r6 to r10, nine diodes, of which four are biased with high current density, D1, D2, D6, D7, and five are biased with low current density, D3, D4, D5, D8, D9, and four bias current sources, I5 to I8. The difference in current density of D1 to D9 can be set in a number of different fashions such as for example by scaling anode (emitter) areas. The high current density diodes D1, D2, D6, D7 are all unity devices and the low current diodes D3, D4, D5, D8, D9 correspond to a parallel connection of n similar diodes.

The diodes D1, D2, D6, D7 operating with high current density have a corresponding voltage drop of $V_{be}(1)$. The diodes D3, D4, D5, D8, D9 operating with low current density have a corresponding voltage drop of $V_{be}(n)$. As will be appreciated from Equation 1, replicated as Equation 22 following, it is known that the base-emitter voltage difference of two bipolar transistors operating with collector currents in a ratio of n, is:

$$\Delta V_{be} = V_{be}(1) - V_{be}(n) = \frac{kT}{Q}\ln(n) \tag{22}$$

At the non-inverting input node of A3 a voltage Vb is established:

$$Vb=3*V_{be}(n) \tag{23}$$

The voltage at the common node of r6 and D9 is:

$$Va=5*V_{be}(n)-2*V_{be}(1)=5*\Delta V_{be}-3*V_{be}(1) \tag{24}$$

It will be appreciated that if the first voltage term in Equation (24) can be made large enough such that at a temperature close to room temperature the feedback current of amplifier A4 is set to zero, then the voltage at the node Vref can be trimmed to a desired value. As the inverting input voltage of A4 is large the noise at the output is low due to the reduced gain factor of A4. The minimum supply voltage of this reference voltage circuit is limited by the stack of three low current density diodes (or base-emitter) voltages, D3, D4, D5. It will be understood that the diodes D1-D9 may be replaced with other circuit elements such as substrate bipolar transistors which may be biased independently.

Figure 16:
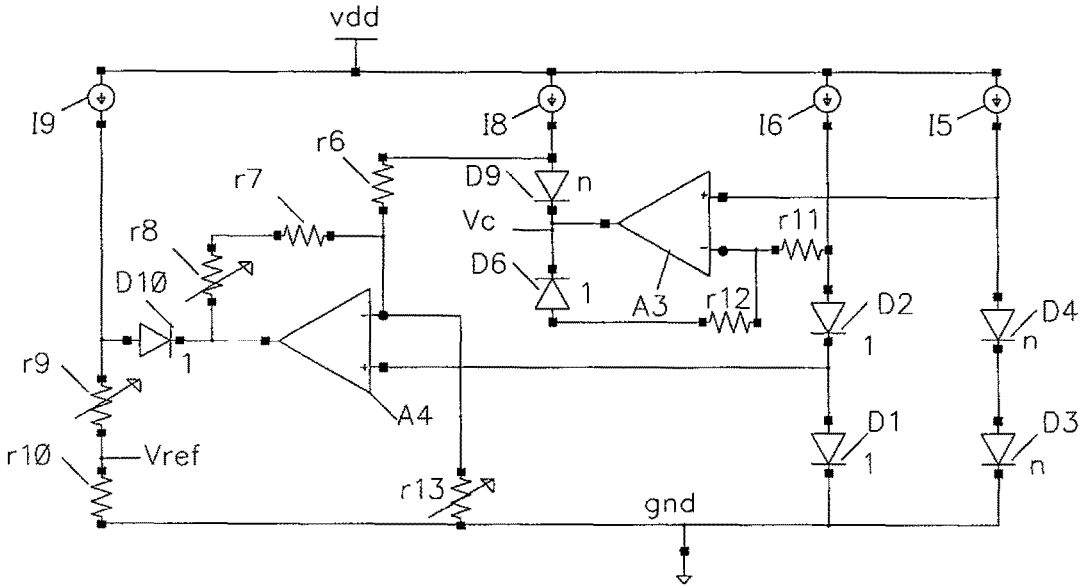
FIG. 16 is a schematic circuit diagram of an exemplary voltage reference circuit.

Referring now to FIG. 16 which shows another exemplary voltage reference circuit which generates current in the form of:

$$I_0 * \left(\frac{T}{T_0} - 1\right) \tag{25}$$

from a combination of multiple base-emitter voltage differences. The voltage reference circuit of FIG. 16 is operable to operate off a lower supply voltage than that of other circuits described herein. The non-inverting node of amplifier A3 corresponds to two base-emitter voltages of low current density diodes, D3, D4. The PTAT voltage difference from these diodes D1, D2 to D3, D4 is developed across a resistor r11. As a result a PTAT current flows through the resistors r11 and r12 and diode D6 such that the output voltage of the amplifier A3 may be set to:

$$Vc = 2 * V_{be}(1) - 2 * \Delta V_{be} * \left(1 + \frac{r_{12}}{r_{11}}\right) \tag{26}$$

The voltage drop crosses the input resistor r6, which sets the feedback current, is:

$$V_{r6} = \Delta V_{be} * \left(3 + 2 * \frac{r_{12}}{r_{11}}\right) - V_{be}(1) \tag{27}$$

As Equation (27) shows by judicious selection of the ratio of the two resistors r12 and r11, the feedback current of A4 can be set to zero at $T_0$. In an alternative configuration, an optional resistor, r13, can be added to force a zero feedback current across A4 at a first temperature, $T_0$. An additional high current density diode, D10, may be provided to raise the output voltage Vref, such that the voltage at the node Vref is:

$$V_{ref} = 2 * V_{be}(T_0) * \frac{r_{10}}{r_9 + r_{10}} \tag{28}$$

Current source I9 is coupled to D10 and r9. The advantages of the reference circuits provided in accordance with the present teaching compared to typical CMOS references and in particular to bandgap voltage reference are numerous and include:

easy to trim for a desired value;
low noise;
tight distribution due to process variation;
high PSRR;
inherent curvature-correction;
low voltage operation.

It will be understood from previous discussions that bandgap type voltage references are based on the addition of two voltages having opposite temperature coefficients, TC. If second order error terms are neglected any bandgap type voltage reference can be express according to the following equation:

$$V_{ref} = K_1 * V_{be}(T) + K_2 * V_{p0} * \frac{T}{T_0} \tag{29}$$

Wherein:

$V_{be}(T)$ is a base-emitter voltage at temperature T,
$V_{p0}$ is a PTAT voltage value at a reference temperature, $T_0$.
$K_1$ and $K_2$ are scaling coefficients.

For high precision voltage reference, accuracy is required in both absolute value and TC. The voltage reference circuits of FIGS. 13 to 16 can be related to equation (30) which provides accuracy in both absolute value and TC.

$$V_{ref} = K_1 * V_{be}(T) + K_2 * V_{p0} * \left(\frac{T}{T_0} - 1\right) \tag{30}$$

Inspection of equations 29 and 30 shows that the first terms in each of the two equations are the same, and correspond to a scaled replica of base-emitter voltage. The second term in equation (30) is different to the second term in equation (29) because it provides a temperature dependent output which is related to the value at a reference temperature $T_0$. As has been discussed with reference to the preceding exemplary circuits such an output will have a negative value for temperatures less than the reference temperature and a positive value for temperatures greater than that reference temperature.

Circuits that are implemented in accordance with the relationship defined in Equation 30 can be trimmed in two temperature steps with high accuracy for both absolute value and TC and are independent of any process variations. At the reference temperature $T_0$, the second term in equation (30) is zero and as a consequence the reference voltage may be determined from a simplified equation:

$$V_{ref}(T_0)=K_1*V_{be}(T_0) \tag{31}$$

It will be appreciated that in this way, as the base-emitter voltage at $T_0$ is process dependent, the scaling factor K1 may be varied through for example trimming until the reference voltage equals the desired value. It will be appreciated that the voltage value is completely independent of contributions from the process dependent voltage, $V_{GO}$.

At the second temperature, T, the reference voltage may be trimmed via variance of the scalar value $K_2$ to the same target voltage value:

$$V_{ref}(T_2) = K_1 * V_{be}(T_2) + K_2 * V_{p0} * \left(\frac{T_2}{T_0} - 1\right) = K_1 * V_{be}(T_0) \tag{32}$$

It will be understood that what has been described herein is a circuit and methodology that provides a voltage reference whose output is independent of process variations. By providing circuitry that generates a PTAT voltage whose output at a preselected temperature can be chosen to be zero it is possible to reduce the number of unknown parameters that are used in generation of bandgap voltage references.

A voltage reference circuit according to the present teaching includes a PTAT source whose polarity reverses at a determinable temperature. The PTAT source is combined with a CTAT source in a manner to remove the effects of the slope of the CTAT source such that a temperature insensitive voltage reference may be generated.

It will be appreciated that another advantage provided by the methodology of the present invention arises from the fact that according to the present teaching, the reference voltage target is always the desired value at any trimming step as compared to the prior art arrangements where the voltage is changed from one step to another because TC and absolute value interact.

While the above has been described with reference to specific exemplary embodiments it will be understood that these are provided for an understanding of the teaching of the invention and it is not intended to limit the invention in any way except as may be deemed necessary in the light of the appended claims. In this way modifications can be made to each of the Figures, and components described with reference to one embodiment can be interchanged with those of another without departing from the spirit and/or scope of the invention.

The words "comprises"/"comprising" when used in this specification are to specify the presence of stated features, integers, steps or components but do not preclude the presence or addition of one or more other features, integers, steps, components or groups thereof.

I claim:

1. A reference circuit configured to provide a reference value, the circuit including:

a first circuit unit configured to provide a first electrical output that varies proportionally with temperature and has a crossover point where its polarity relative to zero changes from a negative value to a positive value, a second circuit unit configured to provide a second electrical output that varies inversely proportionally with temperature, and a third circuit unit having inputs coupled to the first and second electrical outputs, the third circuit unit to generate an electrical output having a value corresponding to a value of the second electrical output at a first predetermined temperature.

2. A circuit as claimed in claim 1, wherein the first circuit unit generates the first electrical output at a zero level at the first predetermined temperature.

3. A circuit as claimed in claim 2, wherein the first circuit unit generates the first electrical output at a positive level at a second predetermined temperature greater than the first predetermined temperature.

4. A circuit as claimed in claim 3, wherein the first circuit unit generates the first electrical output at a negative level at a third predetermined temperature lower than the first predetermined temperature.

5. A circuit as claimed in claim 3, wherein the first and second circuit units induce a value of the combined first and second electrical outputs at the second predetermined temperature corresponding to the value of the second electrical output at the first predetermined temperature.

6. A circuit as claimed in claim 4, wherein the first and second circuit units induce a value of the combined first and second electrical outputs at the third predetermined temperature corresponding to the value of the second electrical output at the first predetermined temperature.

7. A circuit as claimed in claim 5, wherein the second circuit unit generates the second electrical output with a form that is complimentary to absolute temperature.

8. A circuit as claimed in claim 7, wherein the first circuit unit generates the first electrical output with a form that is proportional to absolute temperature.

9. A circuit as claimed in claim 1, wherein the first circuit unit generates the first electrical output having a form $$I_0 * \left(\frac{T}{T_0} - 1\right),$$

wherein T is an actual temperature, $T_0$ is a predetermined temperature, and $I_0$ is a current value.

10. A circuit as claimed in claim 1, wherein the first circuit unit generates the first electrical output as a current.

11. A circuit as claimed in claim 1, wherein the first circuit generates the first electrical output as a voltage.

12. A circuit as claimed in claim 1, wherein the second circuit unit generates the second electrical output as a current.

13. A circuit as claimed in claim 1, wherein the second circuit unit generates the second electrical output as a voltage.

14. A voltage reference circuit to generate a voltage reference, the circuit including:

a first circuit unit to generate a PTAT output which has a crossover point where its polarity relative to zero changes from a negative value to a positive value, a second circuit unit to generate a CTAT output, and a third circuit unit to combine the PTAT and CTAT outputs at a second predetermined temperature different than a first predetermined temperature to generate a value corresponding to the value of the CTAT output at the first predetermined temperature.

15. A reference circuit to generate a reference value, the circuit including:

a first source to generate a PTAT signal which has a crossover point where its polarity relative to zero changes from a negative value to a positive value, a second source to generate a CTAT signal, and a circuit unit to combine the PTAT and CTAT signals at a second predetermined temperature different than a first predetermined temperature to generate a value corresponding to the value of the CTAT signal at the first predetermined temperature.

16. A current reference circuit to generate a current reference value, the circuit including:

a first current source to generate a PTAT current which has a crossover point where its polarity relative to zero changes from a negative value to a positive value, a second current source to generate a CTAT current, and a circuit unit to combine the PTAT and CTAT currents at a second predetermined temperature different than a first predetermined temperature to generate a current value corresponding to the value of the CTAT current at the first predetermined temperature.

17. A voltage reference circuit to generate a voltage reference, the circuit including:

a first set of circuit elements to generate a shifted proportional to absolute temperature (PTAT) voltage, the shifted PTAT voltage having a crossover point where its polarity changes from a negative value to a positive value, a second set of circuit elements to generate a complimentary to absolute temperature (CTAT) voltage, and a third set of circuit elements to combine the CTAT voltage with the shifted PTAT voltage to generate a voltage value corresponding to the value of CTAT voltage at a predetermined temperature.

18. A method of providing a reference value, the method comprising:

providing a first electrical signal that varies linearly with temperature and has a crossover point where its polarity relative to zero changes from a negative value to a positive value, providing a second electrical signal that varies inversely with temperature, and combining the first and second electrical signals at a second predetermined temperature greater than a first predetermined temperature to generate a combined signal having a value corresponding to the value of the second electrical signal at the first predetermined temperature.

19. A method of providing a reference value, the method comprising:

providing a PTAT signal that has a crossover point where its polarity relative to zero changes from a negative value to a positive value, providing a CTAT signal, and combining the PTAT and CTAT signals at a second predetermined temperature different than a first predetermined temperature to generate a combined signal having a value corresponding to the value of the CTAT signal at the first predetermined temperature.

20. A method of providing a reference value, the method comprising:

providing a CTAT signal at a first predetermined temperature, providing a PTAT signal that has a crossover point where its polarity relative to zero changes from a negative value to a positive value, the PTAT signal is:

a) zero at the first predetermined temperature, b) positive at a temperature greater than the first predetermined temperature, and c) negative at a temperature less than the first predetermined temperature, and combining the PTAT and CTAT signals at a second predetermined temperature different than the first predetermined temperature to generate a combined signal having a value corresponding to the value of the CTAT signal at the first predetermined temperature.

* * * * *